United States Patent [19]

Kirchner et al.

[11] Patent Number: 4,746,266

[45] Date of Patent: May 24, 1988

[54] RADIAL BLOWER

[75] Inventors: Heinrich Kirchner, Wurzburg; Udo Winter, Kurnach, both of Fed. Rep. of Germany

[73] Assignee: Siemens Aktiengesellschaft, Munich, Fed. Rep. of Germany

[21] Appl. No.: 94,392

[22] Filed: Sep. 8, 1987

[30] Foreign Application Priority Data

Sep. 19, 1986 [DE] Fed. Rep. of Germany ..... 3631942

[51] Int. Cl.[4] ..... F04D 29/66

[52] U.S. Cl. ..... 415/119

[58] Field of Search ..... 415/119; 416/203, 500

[56] References Cited

U.S. PATENT DOCUMENTS

| | | | |
|---|---|---|---|
| 2,181,628 | 11/1939 | Shawhan | 415/119 |
| 2,251,553 | 8/1941 | Redmond | 415/99 |
| 2,275,564 | 3/1942 | Shawhan et al. | 98/94.1 |
| 2,291,480 | 7/1942 | Marbach | 416/178 |
| 3,688,867 | 9/1972 | Antonetti et al. | 415/119 |
| 3,780,411 | 12/1973 | Bulin | 29/156.4 R |
| 4,419,049 | 12/1983 | Gerboth et al. | 415/119 |

FOREIGN PATENT DOCUMENTS

| | | | |
|---|---|---|---|
| 2043175 | 3/1972 | Fed. Rep. of Germany . | |
| 2164129 | 6/1973 | Fed. Rep. of Germany . | |
| 2618894 | 11/1977 | Fed. Rep. of Germany | 415/119 |
| 3050372 | 10/1982 | Fed. Rep. of Germany . | |
| 2939385 | 11/1982 | Fed. Rep. of Germany . | |
| 18596 | 2/1979 | Japan | 416/203 |
| 85594 | 7/1981 | Japan | 416/203 |
| 441269 | 1/1936 | United Kingdom | 415/119 |
| 469970 | 9/1937 | United Kingdom . | |

*Primary Examiner*—Robert E. Garrett
*Assistant Examiner*—John T. Kwon
*Attorney, Agent, or Firm*—Kenyon & Kenyon

[57] ABSTRACT

In a radial blower with two blower wheels (2, 3) fastened axially in tandem on one shaft end each of the interposed drive motor (b 1) with one blower blade circle (21, 31 respectively) held at a radial distance from the hub (26, 36) on the blower shaft side, the operating noise is to be reduced by simple arrangement while maintaining a high output yield; to this end it is proposed to connect the blower blade ring (21 and 31 respectively) of each blower wheel (2, 3) via spokes (22 to 25, and 32 to 35 respectively) leaving free tangential spaces and to arrange the spokes (22 to 25) of the one blower wheel (2) relative to the spokes (32 to 35) of the other blower wheel, as seen in the axial direction (blower shaft 4) in the gaps (circumferential angle of rotation $\alpha$) relative to each other in the circumferential direction.

6 Claims, 1 Drawing Sheet

RADIAL BLOWER

BACKGROUND OF THE INVENTION

The invention relates generally to a radial blower of the type having two blower wheels which are axially arranged directly or indirectly in tandem on a shaft.

A radial blower of the general type relating to the invention is disclosed in U.S. Pat. No. 2,275,564. From German Patent No. 29 39 385, a radial blower is further known, especially for use in heating and air conditioning systems of motor vehicles, in which a blower wheel is fastened on one end of the engine shaft, in which the intermediate section between the hub fastened to the blower shaft on the one hand and the blade ring of the blower on the other hand is provided with breakthroughs which define spokes.

From DE-OS No. 20 43 175, a noise-attenuated radial blower is known, of which the closed central hub disc is occupied on both sides by additional radial blades which are arranged on the one hub disc side offset preferably by half a blade pitch relative to those on the other hub disc side.

SUMMARY OF THE INVENTION

According to the object of the present invention, a radial blower with two blower wheels is to be provided wherein the blower wheels are directly or indirectly arranged on a shaft, with each of the blower wheels having a radial spacing between a blower blade ring held at a radial distance from a blower wheel hub fastened on the blower shaft and further where the two blower wheels are arranged to permit a substantial reduction of the operating noise while maintaining a high yield output.

A solution to the problem of operating noise and vibration is possible in a radial blower of the type discussed above, according to the invention, by arranging an offset between the spokes of the two blower wheels. The radial blower according to the invention permits, on the one hand, an air conduction distribution of the air flow suctioned-in at both end faces of each blower wheel via the entire discharge width of each blower blade ring by the spoke planes of the blower wheels which are provided with breakthroughs and, on the other hand, a nevertheless low blower operating noise level since the forces which codetermine the operating noise result from the cooperation of the two blower wheels which cancel each other out due to the mutual phase shift brought about by the offset between the blower wheels.

This solution is based on the insight that due to the manufacturing process wherein the blower wheel is advantageously injection-molded from plastic in one piece, the shape of the blower wheel can deviate slightly from the ideal circular shape and a polygon in accordance with the number of spokes can result as an external contour corresponding to the spokes. Accordingly, the offset of the two blower wheels pursuant to the invention causes the vibration forces acting in toto on the blower shaft to advantageously cancel each other out to a large extent. In addition, a substantial reduction of air flow noise is achieved by the fact that the axial air flow between the two blower wheels which can be expected due to the breakthroughs in the spoke plane is caused to occur in an advantageous manner. A basically undesirable axial air flow between the two blower wheels is prevented due to the mutual offset of the blower wheels in the gaps to thereby reduce the axial flow cross section between the inner end faces of the two, offset, axially-spaced, series-connected blower wheels.

The invention as well as further advantageous embodiments of the invention will be explained in the following detailed description of a preferred embodiment of the invention, making reference to the accompanying drawings.

DETAILED DESCRIPTION

Figures 1, 2, 3:
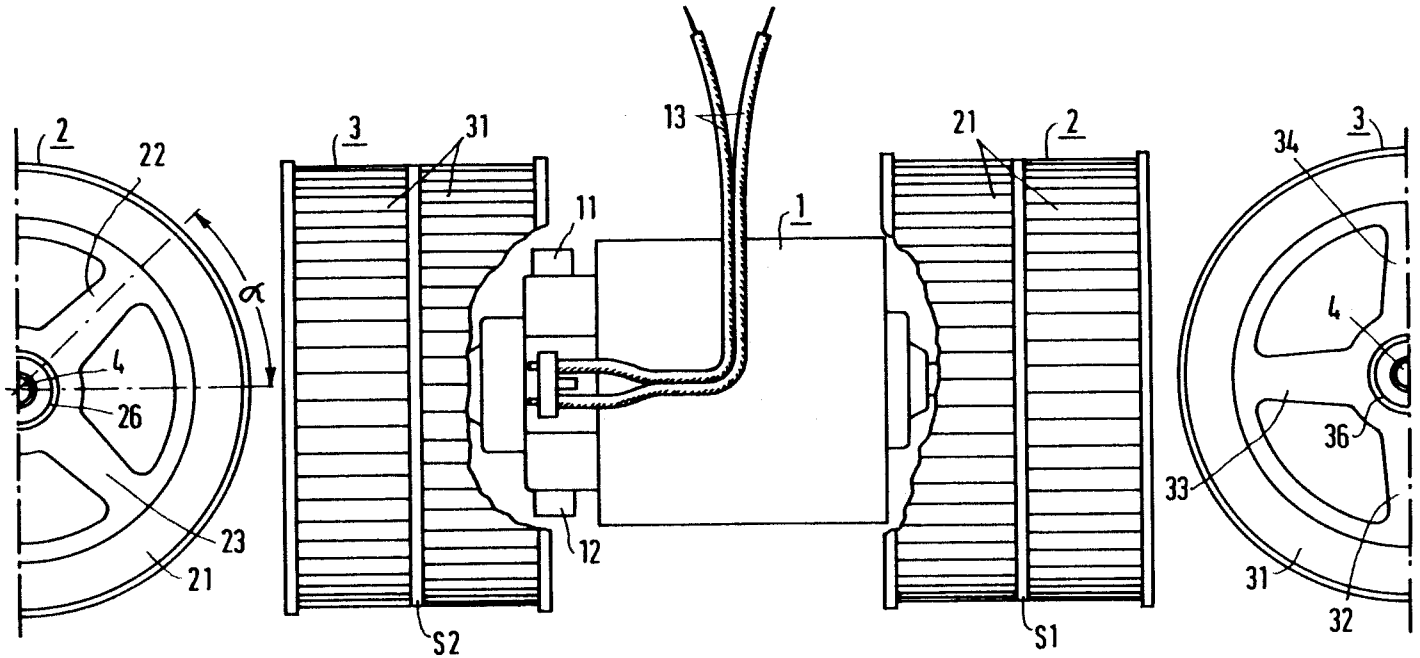
FIG. 1 is an axial top view of the blower wheel arrangement including two blower wheels and an axially centered drive motor.
FIG. 2 illustrates, in a half-picture, a top view of the end face onto the axially outer end face of the first blower wheel.
FIG. 3 illustrates, in a half-picture, a top view of the end face onto the axially outer end face of the second blower wheel.

FIG. 1 shows an axial top view onto the blower wheel drive arrangement of the radial blower provided for heating or air conditioning systems of motor vehicles. On the right-hand motor shaft end of a commutator motor 1, a first blower wheel 2 and on the left-hand motor shaft end of the commuter motor 1, a second blower wheel 3 are firmly mounted. The motor shaft thus serves at the same time as the blower shaft 4. Both blower wheels 2 and 3 are surrounded by a spiral housing as the air conduciton housing in a manner not shown here, but generally known. The armature winding of the permanent-magnet-excited commutator motor 1 is fed via brush holders 11, 12 from an electrical lead 13.

FIGS. 2 and 3 each show in a half-picture the top view on the respective axially outer end face of the blower wheels 2 and 3 which are injection-molded from plastic in one piece as mutually identical unitized parts. Each blower wheel 2, 3 has a hub 26, 36 for fastening the blower wheel on the blower shaft 4; a blower blade ring 21, 31 as well as four spokes lying each in a spoke plane S1, S2, 22 to 25 and 32 to 35 of which, in FIG. 2, only the spokes 22, 23 of the right hand blower wheel 2, and, in FIG. 3, only the spokes 32 to 34 of the left hand blower wheel 3 are visible. The spoke planes S1 and S2 of each blower wheel 2 and 3 are located axially centered between the end faces of their blower wheels in a manner advantageous with respect to design and mass balance. Between the spokes 22 to 25 and 32 to 35, breakthroughs are provided in the spoke planes S1 and S2 in such a manner that an axial air conduction compensation of the air streams entering at both end faces of each blower wheel can take place in the sense of a uniform full action upon the discharge side of the blower wheel in spite of the possibly impeded air entry due to the centralized drive motor at the inner end faces facing the drive motor 1, of each blower wheel 2 and 3.

According to the invention, the identical blower wheels 2 and 3, designed as unitized parts, are fastened on the common blower shaft 4 in such a manner that they are arranged, as seen in the direction of the axis, mutually offset by the circumferential angle of rotation $\alpha$. (See FIG. 2.) With the distribution provided in the described embodiment of four spokes 22 to 25 and 32 to 25 over the circumference of the spoke planes S1 and S2, the circumferential angle of rotation $\alpha$ is therefore 45°. In general, i.e., with blower wheels having a spoke distribution of any particular number of spokes, the circumferential angle of rotation $\alpha$, as illustrated in FIG. 2, is a fixed angle equal to approximately one half the circumferential angle between the spokes of the blower wheel.

The above described preferred embodiment of the invention is meant to be representative only, as certain changes may be made therein by those skilled in the art without departing from the clear teachings of the invention. Accordingly, reference should be made to the following appended claims which alone define the invention.

What is claimed is:

1. A radial blower of the type including two blower wheels arranged in an axially spaced relation on a blower shaft; wherein each of said blower wheels comprises a blower wheel hub mounted upon said blower shaft and a blower blade circle mounted upon said blower wheel hub in a radially spaced position relative to said blower wheel hub by means of a plurality of spokes; said spokes defining tangential spaces therebetween;

an improvement comprising:

the spokes of one of said blower wheels, as seen in the direction of an axis defined by said blower shaft, being angularly offset from the spokes of the other of said blower wheels in the circumferential direction by a fixed circumferential angle of rotation equal to approximately one half the circumferential angle between the spokes of said blower wheels.

2. The radial blower according to claim 1, further characterized by the spokes of each of said blower wheels all being arranged in a single, radially-centered, spoke plane within the respective blower wheel (2, 3) (S1 and S2, respectively).

3. The radial blower according to either claim 1 or 2, further characterized by the spokes (22 to 25) of said one of said blower wheels (2) being angularly offset so as to be exactly centered between the spokes (32 to 35) of said other of said blower wheels (3), as seen in the direction of the axis defined by said blower shaft.

4. The radial blower according to claim 2, further characterized by each of said blower wheels including four spokes (22 to 25, 32 to 35) arranged offset relative to each other by a circumferential angle of rotation of 90° within the respective spoke plane (S1, S2).

5. The radial blower according to either of the claims 1, 2 or 4, further characterized by said blower wheels (2, 3) being formed to be identical with one another and being arranged on the blower shaft (4) to be offset against each other by said fixed circumferential angle of rotation.

6. The radial blower according to either of the claims 1, 2 or 4, further characterized by (a) a common drive motor for both of said blower wheels;

(b) said common drive motor including said blower shaft (4); and (c) said one of said blower wheels (2) being mounted on one end of the blower shaft (4) and said other of said blower wheels (3) being mounted and angularly offset by said fixed circumferential angle of rotation on the other end of said blower shaft (4).

* * * * *